US011905769B2

(12) United States Patent
Schauerte et al.

(10) Patent No.: US 11,905,769 B2
(45) Date of Patent: Feb. 20, 2024

(54) DRIVE AND A METHOD FOR OPERATING A DRIVE OF A GROUND DRILLING DEVICE

(71) Applicant: TRACTO-TECHNIK GmbH & Co. KG., Lennestadt (DE)

(72) Inventors: Manfred Schauerte, Schmallenberg (DE); Christian Löher, Eslohe (DE); Manuel Pohl, Lennestadt (DE); Florian Gies, Eslohe (DE)

(73) Assignee: TRACTO-TECHNIK GMBH & CO. KG, Lennestadt (DE)

( * ) Notice: Subject to any disclaimer, the term of this patent is extended or adjusted under 35 U.S.C. 154(b) by 186 days.

(21) Appl. No.: 17/467,176

(22) Filed: Sep. 3, 2021

(65) Prior Publication Data

US 2022/0098937 A1 Mar. 31, 2022

(30) Foreign Application Priority Data

Sep. 30, 2020 (DE) ..... 102020005981.3

(51) Int. Cl.
*E21B 19/086* (2006.01)
*E21B 17/046* (2006.01)
*E21B 7/04* (2006.01)

(52) U.S. Cl.
CPC ..... *E21B 19/086* (2013.01); *E21B 7/046* (2013.01)

(58) Field of Classification Search
CPC ..... E21B 17/00; E21B 17/02; E21B 17/046; E21B 17/22; E21B 19/086; E21B 7/205; E21B 7/206; E21B 7/30; F16L 55/1658
See application file for complete search history.

(56) References Cited

U.S. PATENT DOCUMENTS 4,000,879 A 1/1977 Martin et al.
4,542,796 A * 9/1985 Delbarre ..... E21B 7/205 175/22
5,025,857 A * 6/1991 McLeod ..... E21B 23/06 166/80.1
6,279,667 B1 * 8/2001 Culver ..... E21B 7/26 175/19
7,798,252 B2 * 9/2010 Barbera ..... E21B 7/046 175/325.2
9,243,453 B2 * 1/2016 Koch ..... E21B 19/086

FOREIGN PATENT DOCUMENTS

DE 19849611 C1 3/2000
DE 202004005461 U1 6/2004

* cited by examiner

*Primary Examiner* — Nathaniel C Chukwurah
(74) *Attorney, Agent, or Firm* — Leason Ellis LLP

(57) ABSTRACT

A drive of a ground drilling device for pushing or pulling introduction of a drill string with a frame and a slide that can be moved back and forth relative to the frame, wherein there is at least one hydraulic cylinder between the frame and the slide for moving the slide, and wherein the hydraulic cylinder can be arranged in a removable manner in two different working directions between the frame and the slide.

10 Claims, 2 Drawing Sheets

DRIVE AND A METHOD FOR OPERATING A DRIVE OF A GROUND DRILLING DEVICE

FIELD OF INVENTION

The invention relates to a drive of a ground drilling device for pushing or pulling introduction of a drill string, a method for operating a drive of a ground drilling device for driving a drill string into the soil in the pushing or pulling working direction, and a use of a drive of a ground drilling device for pushing or pulling introduction of a drill string.

BACKGROUND

It is known to use a drive of a ground drilling device for pushing or pulling introduction of a drill string, wherein a push-pull drive engages projections or recesses of a drill string by coupling with a tool on the end. For example, DE 196 08 980 C2 describes a drilling device that consists in a carriage with a hydraulic piston cylinder unit that moves a slide linearly back and forth. The slide is connected to a pawl that, when the slide is advanced, engages behind a rung of a ladder rod, which is part of a drill string, and thus moves the ladder rod with the drill head forward in the drilling direction in accordance with the stroke of the hydraulic piston cylinder unit. At the end of the stroke, the pawl is automatically released from the rung, and the slide moves back to its starting position. Due to the high forces, the hydraulic piston cylinder unit is firmly connected to the slide and a frame on the carriage.

DE 198 49 611 C1 describes the use of a double-acting hydraulic cylinder as a hydraulic piston cylinder unit or linear drive. Both cylinder chambers therein can be connected to a pressure source via one hydraulic line each with a 4/3 directional valve, between which a shuttle valve with a pressure gauge that measures the current pressure is connected, the shuttle valve switching the 4/3 directional valve via a control device upon reaching a maximum pressure, thereby connecting one or the other hydraulic line to the pressure source.

SUMMARY

The invention was based on the object of creating an improved alternative for a drive for a ground drilling device, a method for operating a drive for a ground drilling device, and a use of a drive for a ground drilling device for which a drill string that can move in both directions is inexpensive, in particular forgoes complex pressure control measures, is of simple design, in particular exhibits a small constructed space, and/or uses force efficiently, in particular fully.

It was recognized that preconceptions are gone against in the context of the invention. Contrary to the prevailing opinion, which generally considered a fixed connection of the hydraulic piston cylinder unit or hydraulic cylinder to be absolutely necessary, it was recognized that it is possible to embody a connection of a hydraulic cylinder between the frame and slide of the ground drilling device that can be removable on at least one side. As a result, a hydraulic cylinder can be arranged in a removable manner between the frame and the slide in two different working directions. It was recognized that a hydraulic cylinder can easily be rotated with regard to its working direction, even for a ground drilling device that is exposed to harsh conditions, without removing fixed connections (i.e., joined materials in particular). In particular, it was recognized that when the hydraulic cylinder is arranged between the frame and the slide after the hydraulic cylinder has been rotated transverse to its longitudinal direction, pressure can always be applied to one and the same side of the hydraulic cylinder, in particular the piston side, for the working movement when pushing as well as for the working movement when pulling. Thus, especially when using a differential cylinder, high forces are available for the working movement or working direction (piston area), and high speeds are available for the idle stroke (due to the smallest possible piston ring areas or a piston rod with a large diameter). A high force for moving the drill string and a fast travel speed of the hydraulic cylinder, in particular during the idle stroke, can be achieved. Furthermore, the removable connection of the hydraulic cylinder to the slide and/or the frame enables simple transport. In addition, simple assembly on site, even in a small excavation pit, can be enabled. Complex adjustment work can also be forgone. In particular, it can be designed that for a hydraulic cylinder with a cylinder tube and a piston rod, the cylinder or the cylinder tube of the hydraulic cylinder always remains connected to the slide, and the piston rod can be attached in a removable manner to two different areas of the frame in both working directions. There is a clear additional benefit for the user, since the achievable advantages could previously not be realized. The simplicity of construction, transport, assembly, adjustment, and/or the efficiency of operation with regard to the two working directions can lead to increased efficiency.

The invention establishes a drive of a ground drilling device for pushing or pulling introduction of a drill string with a frame and a slide that can be moved back and forth relative to the frame, wherein there is at least one hydraulic cylinder between the frame and the slide for moving the slide. The hydraulic cylinder can be arranged in a removable manner in two different working directions between the frame and the slide.

In the context of the description, the term "drill string" denotes a string that has a ground drilling tool and a rod and that can be moved by means of a ground drilling device or a driving device to create an earth borehole through the soil.

In the context of the description, the term "rod" comprises not only rigid rods with individual rod sections directly or indirectly connected to one another that can be used with a ground drilling device, but rather in particular all force transmission elements that can be used in a ground drilling device. Rigid rod sections, particularly those that can be connected by means of a plug connection, are preferred. In a particularly preferred embodiment, a plug connection can be formed between two adjacent rod sections, secured by means of a pin inserted transverse to the longitudinal axis of the rod sections.

The term "rod section" in the context of the description denotes an element that extends along a longitudinal axis and that is part of the rod or the drill string for ground drilling. The rod section can be designed as an element at the front of the drill string with an assigned function (e.g., a transmission housing), or it can be designed as an element that extends the drill string (only mechanically) as a rod section. The rod section can comprise mechanical channels for, for example, drilling fluid, electrical conductors, electrical components, and/or electronic components.

In a preferred embodiment, a rod section in the context of the description can have an outer diameter of 25 mm to 65 mm, preferably 30 mm to 60 mm, preferably 35 mm to 55 mm, preferably 40 mm to 50 mm. In a preferred embodiment, a rod section in the context of the description can have a total length of 450 mm to 650 mm, preferably 500 mm to 600 mm, preferably 520 mm to 580 mm. In a preferred embodiment, a rod section in the context of the description can have an effective length that takes into account in particular the length of the connecting elements, in particular the connecting elements provided at the end, for example a length of the connecting socket and/or the connecting plug in the case of a plug connection. The effective length can result from the total length minus the length of the connecting element or elements and can be 400 mm to 600 mm, preferably 450 mm to 550 mm, preferably 475 mm to 525 mm. In a preferred embodiment, a rod section in the context of the description can have a groove for engaging an engaging element for moving the drill string, for example a (locking) pawl, which can have an outer diameter of 15 mm to 55 mm, preferably 20 mm to 50 mm, preferably 25 mm up to 45 mm, preferably 30 mm to 40 mm. In a particularly preferred embodiment, the total length of the rod section can be 550 mm and the outer diameter of the rod section 45 mm. In a particularly preferred embodiment, the effective length of the rod section can be 500 mm. In a particularly preferred embodiment, the outer diameter of a groove for engaging an engaging element for moving the drill string can have an outer diameter of 35 mm. The stated values for the outer diameter of the rod section, the (total) length of the rod section, the effective length of the rod section, and the outer diameter of a groove on the rod section are not values that restrict the dimensions. It is to be emphasized that an adaptation to the external conditions, in particular the size of the excavation pit or the shaft for the arrangement of the ground drilling device and/or the nature of the soil, can occur to carry out an earth borehole efficiently.

The term "ground drilling tool" denotes a drilling head at the front of the drill string, for which movable parts can exist. It can also be stipulated, though, that the drilling tool has an immovable or rigid, or mostly immovable or rigid, outer contour.

The term "ground drilling device" in the context of the description comprises any device that can move in particular a drill string having rod sections in an existing passage in the soil or in one to be created in order to create or widen a borehole, in particular a horizontal drill hole, or to pull pipelines or other long bodies into the soil. A ground drilling device can comprise a drive or driving device that pulls and/or pushes a drill string. It can additionally or alternatively be stipulated that the drive can rotate the drill string in a certain angular range about the longitudinal axis of the drill string. It is possible to have a rotary drive, wherein a back-and-forth movement is possible in the form of a rotation in both directions of rotation about the longitudinal axis of the drill string in a certain angular range (a so-called "paddle" operation).

The term "horizontal drilling" in the context of the description comprises in particular any type of passage in a body, preferably horizontal, existing or to be created, particularly earth passages including earth boreholes, rock boreholes, or earth conduits as well as underground or above-ground pipelines and water channels, that can be created or pulled in by using an appropriate ground drilling device.

In the context of the description, the term "frame" denotes a component of a ground drilling device that can be located in an excavation pit or a shaft, in particular a channel shaft, to render possible a track for moving a slide back and forth relative to the frame. The ground drilling device can be supported in an excavation pit, in a shaft, or on the soil by means of the frame. The frame can define a track or a path for moving the slide back and forth. In a preferred embodiment, the footprint of the frame is rectangular. The frame can have a length in the longitudinal extension of the hydraulic cylinder that is preferably 550 mm to 1050 mm, more preferably 600 mm to 1000 mm, more preferably 650 mm to 950 mm, more preferably 700 mm to 900 mm, more preferably 750 mm to 900 mm, more preferably 800 mm to 900 mm. The frame can have a length transverse to the longitudinal extension of the hydraulic cylinder of preferably 350 mm to 600 mm, more preferably 350 mm to 550 mm, more preferably 350 mm to 500 mm, more preferably 400 mm to 500 mm, more preferably 450 mm to 500 mm. The listed dimensions can apply to the footprint, whereby next to the frame, in particular extending transverse to the longitudinal direction of the hydraulic cylinder, a guide tube for supporting the frame in the excavation pit or the shaft can be provided, from which support elements can be extended and brought into contact with the excavation pit or the shaft.

The term "slide" in the context of the description denotes an element of the ground drilling device that has an engaging element for engaging with the drill string and which can be moved back and forth relative to the frame.

In a preferred embodiment, the hydraulic cylinder can be positively connected to the slide and/or the frame in the two different directions by inserting or installing the hydraulic cylinder to holders on the slide and/or frame. As a result, the hydraulic cylinder can easily be removed from the frame or slide if necessary. The effective direction of the hydraulic cylinder can be reversed or turned around. In addition, a simple insertion or installation of the hydraulic cylinder enables simple removal or simple transport of the drive. If the hydraulic cylinder can be lifted out of a holder, in particular, no joined materials between the frame and the hydraulic cylinder or the slide and the hydraulic cylinder have to be removed.

In a preferred embodiment, the connection of the hydraulic cylinder both on the frame and on the slide can be easily removed and electively connected. If removing and connecting of slides or frames is described, this description can also apply to the other connection to the hydraulic cylinder. However, it is also possible that the hydraulic cylinder is attached to the slide in such a way that a simple removal, in particular in the form of taking the hydraulic cylinder out or lifting it, is not possible. For example, it can be designed that the hydraulic cylinder can be attached to the slide in a fixed manner so that it can rotate about a pivot point, so that in particular the cylinder or the cylinder tube of the hydraulic cylinder remains connected to the slide, and the piston rod is attached in a removable manner to another area of the frame. Particularly preferably, the cylinder tube can be arranged or connected in a removable manner in both working directions of the drive in the area of the slide. The piston rod of the hydraulic cylinder can be connected to the frame in a removable manner in both working directions, wherein the piston rod can be connected in one working direction to a section of the frame that is closer to the earth borehole and can be connected in the other working direction to a section of the frame that is farther from the earth borehole.

In a preferred embodiment, the hydraulic cylinder has a piston rod and a cylinder tube, the piston rod and/or the cylinder tube having (a) a first engaging element or
(b) a holder for a second engaging element, and the slide and/or the frame having
(c) a holder for the first engaging element or
(d) the second engaging element.

By means of the embodiment described, a positive fit that fixes the hydraulic cylinder relative to the slide and/or the frame is possible. Because of the force acting in one direction or exerted by the hydraulic cylinder, a structure of the positive fit can be achieved that is simple in design and yet enables secure attachment.

In a preferred embodiment, the first engaging element and/or the second engaging element is a groove formed between two delimiting surfaces, wherein the groove, the holder, and the delimiting surfaces are adapted to one another such that a positive fit in the longitudinal direction of the piston rod and/or the cylinder tube can be achieved. This enables a simple geometric embodiment of the elements for engagement between the hydraulic cylinder and the frame and/or the hydraulic cylinder and the slide. The formation of a groove with corresponding delimiting surfaces and an engaging element adapted to the groove provides a structurally simple option for designing the drive.

In a preferred embodiment, a holder adapted to the cylinder or the cylinder tube is provided on the slide. It can be designed that the dimension or length of the holder corresponds essentially to the length of the cylinder or cylinder tube or the distance between two structural elements on the cylinder or cylinder tube, in particular the stops, so that the cylinder or cylinder tube can easily be inserted into the holder on the slide in order to form a removable connection between the hydraulic cylinder and the slide. It can be designed that the holder on the slide has two structural elements, in particular in the form of two projections, which are spaced apart in the longitudinal direction of the hydraulic cylinder and each have a surface. The two surfaces can in particular face one another. When the cylinder tube is inserted, the two surfaces can interact with two stops on the cylinder tube in such a way that both surfaces simultaneously rest against a stop on the cylinder tube, whereby the slide can be fixed to the cylinder tube in both directions of movement of the hydraulic cylinder. It can also or alternatively be designed that at least one, preferably two holders can be provided on the frame, which are adapted to a structural element of the piston rod, so that the structural element can be inserted or installed on the frame in order to form the connection between the piston rod or the hydraulic cylinder and the frame. It can be designed that at least one holder is formed on the end of the frame, into which a structural element of the piston rod can be inserted. Preferably, two holders, which are formed on ends opposite one another, can be provided. The arrangement of two holders on opposite ends is preferably such that the connecting line of the two holders runs along the two working directions. By forming a holder on one end of the frame, the entire length of the frame can be used for the arrangement of the hydraulic cylinder.

A handle that can facilitate the transport and handling of the hydraulic cylinder can be formed on the structural elements of the cylinder tube (if there are any) that can be provided for fixing the slide in the holder. For example, the handle can be designed as an element connecting the stops on the cylinder tube that are spaced apart from one another in the longitudinal direction. Planning, design, and manufacture can be simplified. The handle can extend parallel to the cylinder tube at a distance therefrom.

In a preferred embodiment, the hydraulic cylinder is a differential cylinder, which offers an inexpensive option. In addition, a differential cylinder enables the possibility of forgoing complex pressure control measures. In a particularly preferred embodiment, a hydraulic cylinder can be selected whose diameter of the piston rod is large relative to the piston area, since the piston ring area can then be small. The hydraulic cylinder can have a length of 400 mm to 650 mm, preferably 450 mm to 600 mm, preferably 500 mm to 600 mm, preferably 500 mm to 550 mm. The hydraulic cylinder can have a piston diameter of 50 mm to 120 mm, preferably 50 mm to 100 mm, in particular 70 mm. The hydraulic cylinder can have a stroke between 200 mm to 350 mm, preferably 200 mm to 300 mm, more preferably 250 mm to 300 mm, in particular 270 mm. The piston rod diameter of the hydraulic cylinder can be between 25 mm to 60 mm, preferably 25 mm to 50 mm. It is possible that the ratio of the piston diameter to the piston rod diameter is such that with essentially the same oil flow for the two directions of movement, the speed when the piston ring surface is applied (idle stroke) is about twice as fast as when the piston surface is applied for the working stroke.

In a preferred embodiment, two hydraulic cylinders are provided, which are arranged symmetrically to one another to the frame and/or slide. This allows the force to act symmetrically between the slide and the frame. A stable, uniform development of force is possible.

In a preferred embodiment, an engaging element, for example in the form of a locking pawl, is arranged on the slide such that it can be rotated. A locking pawl can provide a simple embodiment of an engaging element, wherein the drill string can be engaged, and a force can be impressed upon the drill string. For engaging the drill string, rod sections can be used that have one or more recesses or grooves formed on the outer surface.

In a preferred embodiment, an element of a plug-in or screwed connection is formed on the cylinder tube for connecting a hydraulic line. Such a configuration can simplify transport or removal of the drive in that, for example, in addition to removal of the hydraulic cylinder from the slide and/or frame, supply lines for connecting a hydraulic line to the cylinder tube can also be removed.

The invention also establishes a method for operating a drive of a ground drilling device for driving a drill string into the soil in the pushing or pulling working direction with a frame, a slide that can be moved back and forth relative to the frame, and at least one hydraulic cylinder between the frame and slide for moving the slide relative to the frame. To reverse the working direction, the hydraulic cylinder is removed from the frame and/or slide and rotated transverse to its longitudinal axis. The cylinder tube can preferably remain in the area of the slide or be arranged there again after the hydraulic cylinder has been rotated, and the piston rod of the hydraulic cylinder can be connected to the frame in both places, the piston rod being connected in one working direction to a section of the frame that is closer to the earth borehole and being connected in the other working direction to a section of the frame that is farther from the earth borehole.

The invention also establishes the use of a drive of a ground drilling device for pushing or pulling introduction of a drill string with a frame and a slide that can be moved forward and backward relative to the frame. A hydraulic cylinder is arranged between the frame and the slide to move the slide. An electively removable connection of the hydraulic cylinder is used to change the working direction of the drive.

Explanations of the individual aspects of the invention, as they are described in relation to the drive, the method, and the use, are to be understood as explanations that complement one another. Explanations of one aspect also apply to the explanations of one of the other aspects.

Neither the above statements of nor the following description of exemplary embodiments constitute a waiver of any particular embodiments or features.

BRIEF DESCRIPTION OF THE DRAWINGS

The invention is clarified below with reference to the exemplary embodiment shown in the figures.

The figures show.

DETAILED DESCRIPTION

Figure 1:
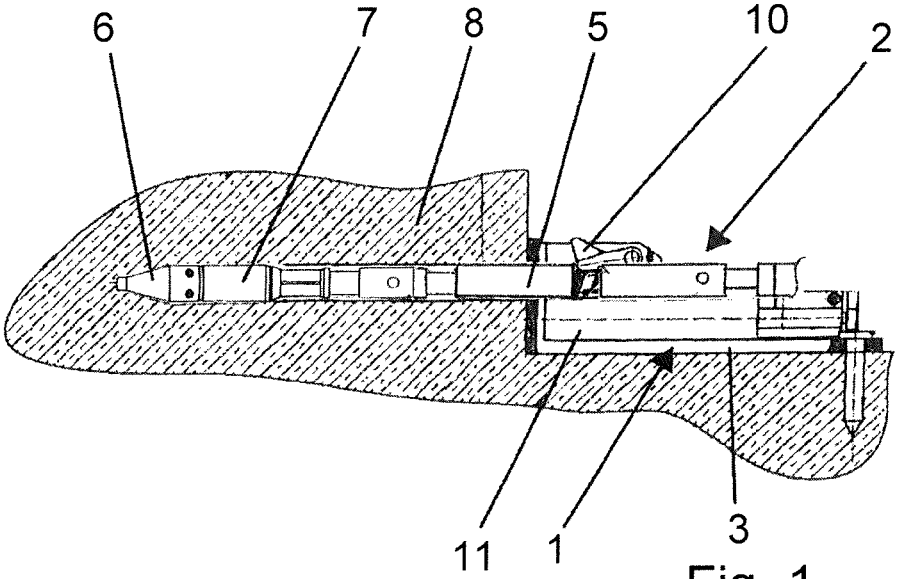
FIG. 1 a ground drilling device with a drill string and a drive in a partially sectioned side view.

FIG. 1 shows, in a partially sectioned side view, a ground drilling device 2 inserted in a launch pit 3. A drill string 5 with a ground drilling tool in the form of a drilling head 6 at the front can be introduced into the soil 8 by means of the ground drilling device 2. A transmitter holder 7 is arranged in the drill string 5 behind the drilling head 6.

The pushing or pulling introduction of the drill string 5 takes place by two hydraulic cylinders 1, which move a locking pawl 10 back and forth. The locking pawl 10 is attached to a slide 12. The locking pawl 10 is attached to the slide 12 such that it can be rotated for changing the working direction. The slide can move relative to a frame 25, which has a front frame plate 20 and a rear frame plate 14 on the ends, by means of actuation of the hydraulic cylinders 1. A fixed point for the removable fastening of the hydraulic cylinder 1 is provided on the frame 25 on the front frame plate 20 and on the rear frame plate 14.

Figure 2:
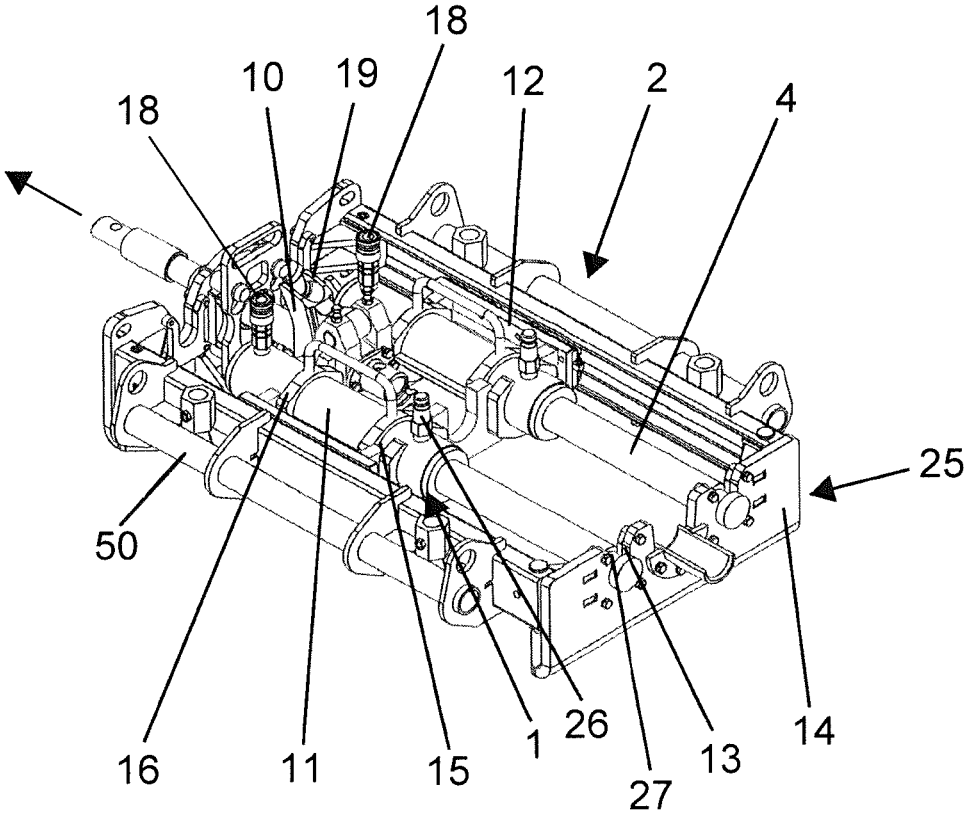
FIG. 2 a drive in a first working direction of a ground drilling device in an isometric view.

To move the drill string 5, the locking pawl 10 in the position shown in FIGS. 1 and 2 slides out of a groove 9 of the drill string 5 during the retraction (idle stroke) and falls into another groove 9 when it is reached, so that the hydraulic cylinders 1 can advance the drill string 5 further in the working position as schematically shown in FIG. 2.

Figure 3:
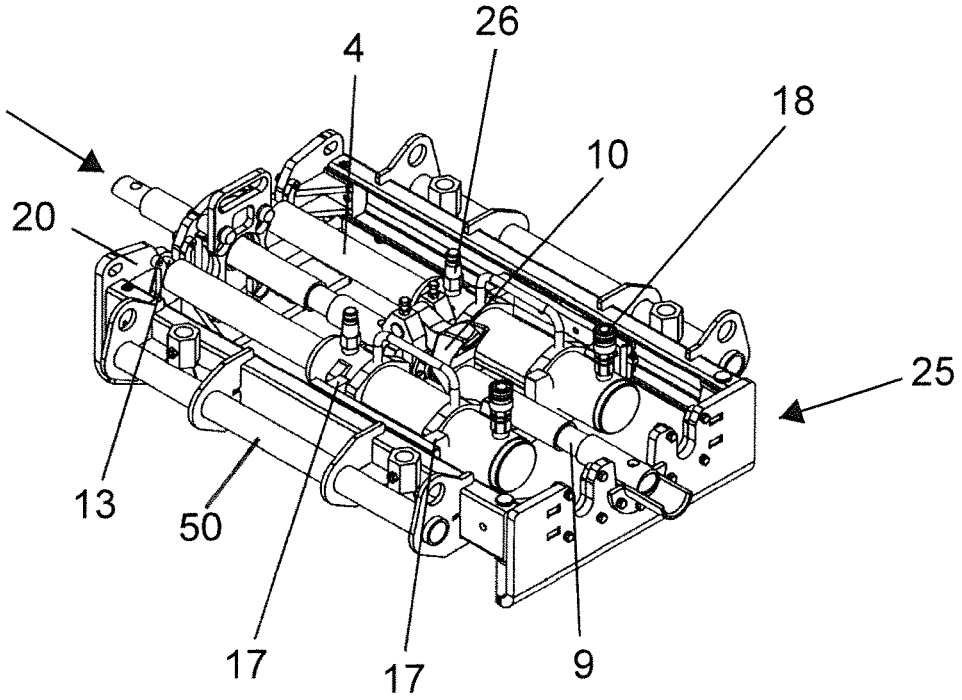
FIG. 3 the drive of FIG. 2 in an isometric view with its working direction having been changed.

For a pulling working direction of the hydraulic cylinders, shown in FIG. 3, the hydraulic cylinders are rotated transverse to their longitudinal direction. It is possible that the cylinder or piston side of the hydraulic cylinder 1 with the greater force is (further) available for the working stroke, and the piston rod side is (always) available for a quick return stroke.

While FIG. 2 shows the arrangement of the hydraulic cylinders 1 in relation to the slide 12 and frame 25 for a pushing introduction of the drill string 5, FIG. 3 shows a pulling working direction, whereby in both FIG. 2 and FIG. 3, the position of the hydraulic cylinders 1 is shown in each case after completion of the working stroke (cylinder extended).

In FIG. 2, the two hydraulic cylinders 1 are hung with their piston rods 4 in grooves 13 of a rear frame plate 14. The piston rods in turn each have a recess, or groove 27, that is adapted to the thickness of the frame plates 14 and 20. The groove 13 in the frame plates 14, 20 is in turn adapted to the diameter of the piston rod 4 in the area of the groove 27. The frame plate 14 forms the fixed point for the advancement or the pushing working direction, as it can be used, for example, for a pilot borehole.

Figure 4:
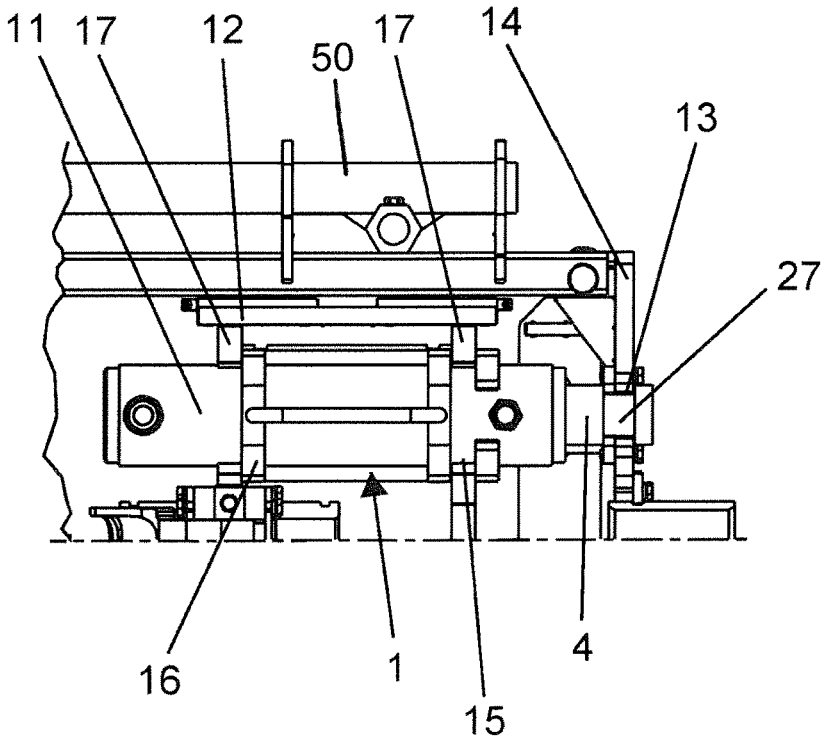
FIG. 4 an enlarged view of a portion of the drive of FIGS. 2 and 3 from above.

The cylinder tubes 11 of the hydraulic cylinders 1 are hooked on one side by a groove 15 and on the other by a stop 16 by projections 17 of the slide 12, as shown in FIG. 4, which shows an enlarged view of the drive of FIGS. 2 and 3 from above. A stop 16 for a projection 17 is provided on each cylinder tube 11. The cylinder tube 11 is fixed between the projections 17 by means of the stops 16 on the cylinder tube 11. The stops 16 fix the cylinder tube 11 between the projections 17 in the two working directions of the hydraulic cylinder 1. A handle is formed between the stops 16 for handling the cylinder tube 11 or the hydraulic cylinder 1, by means of which the hydraulic cylinder 1 can be lifted out of the slide 12 and out of the groove 13.

In FIGS. 2 to 4, guide tubes 50 are arranged on the frame 25 that extend parallel to the working direction of the ground drilling device 2 or the direction of movement of the slide 12. Extendable support elements, which are not shown, can be arranged in the guide tubes 50, by means of which the frame 25 can be supported in the excavation pit or the shaft.

If the piston sides of the hydraulic cylinders 1 are now subjected to pressure via the hydraulic plug-in couplings 18, the slide 12 moves to the left in the illustration shown in FIG. 2, as indicated schematically by the arrow in FIG. 2, so that the slide 12 moves to the left in the embodiment shown in FIG. 2. The locking pawl 10 engages in a groove 9 of the drill string 5 and pushes the drill string forward. The idle stroke then takes place in that the piston ring chamber of the hydraulic cylinder 1 is pressurized by means of the hydraulic plug-in couplings 26. This idle stroke takes place at high speed, in particular when the diameter of the piston rods 4 is selected to be large and the piston ring surfaces are therefore very small. During the idle stroke, the locking pawl 10 moves over a bevel 19 out of a groove 9 of the drill string 5 to tilt back into another groove 9 of the drill string 5 toward the end of an idle stroke in order to carry out another working stroke and thus realize further advancement. As soon as the drilling head 6 has arrived at, for example, a target pit (not shown), the drilling head 6 can be exchanged for a tool (not shown) for pulling in lines of all kinds.

For the pulling drive of the drill string 5, the drive is set up in the configuration shown in FIG. 3.

The hydraulic cylinders 1 have been rotated 180° transverse to their longitudinal axes compared to FIG. 2. For this purpose, the hydraulic cylinders 1 are lifted up, the piston rods 4 are set with their grooves 13 in the front frame plate 20, and the cylinder tube 11 is set in the slide 12. For the pulling working direction, the front frame plate 20 is now the fixed point for the retraction. The locking pawl 10 is turned over so it can be effective in the opposite direction. When the piston is pressurized by the hydraulic cylinder 1, the locking pawl 10 again engages in a groove in the drill string 5 and pushes it to the right in the illustration shown, whereby a pipe (not shown) can be drawn into the pilot borehole that has already been made.

As has already been described with regard to FIG. 2, the steps of the working stroke and the idle stroke are repeated until, for example, the pipe to be pulled in has reached the launch pit 3. By means of the configuration of the ground drilling device 2 shown in FIG. 3, the working stroke is carried out with high force by applying pressure to the piston side, and the idle stroke is carried out at high speed by applying pressure to the piston ring side.

The invention claimed is:

1. A drive of a ground drilling device for pushing or pulling insertion of a drill string with a frame and a movable slide movable back and forth relative to the frame, comprising: at least one hydraulic cylinder for moving the slide relative to the frame; wherein the at least one hydraulic cylinder is arranged in a removable manner in two different working directions between the frame and the slide, wherein the at least one hydraulic cylinder is configured to be rotated in such a way that, after a rotation of the at least one hydraulic cylinder transverse to a longitudinal direction thereof, one side of the at least one hydraulic cylinder is adaptable to be pressurized for both pushing working movement and pulling working movement.

2. The drive according to claim 1, wherein the at least one hydraulic cylinder is positively connected to the slide and/or the frame in the two different directions by inserting or installing the at least one hydraulic cylinder to holders on the slide and/or frame.

3. The drive according to claim 1, wherein the at least one hydraulic cylinder comprises a piston rod and a cylinder tube, the piston rod and/or the cylinder tube having a) a first engaging element or b) a holder for a second engaging element, and the slide and/or the frame having a) a holder for the first engaging element or b) the second engaging element.

4. The drive according to claim 3, wherein the first engaging element and/or the second engaging element is a groove formed between two delimiting surfaces, wherein the groove, the holder, and the delimiting surfaces are adapted in relation to one another such that a positive fit is achieved in the longitudinal direction of the piston rod and/or the cylinder tube.

5. The drive according to claim 3, further comprising an element of a plug-in or screwed connection for connecting a hydraulic line on the cylinder tube.

6. The drive according to claim 1, wherein the at least one hydraulic cylinder is a differential cylinder.

7. The drive according to claim 1, wherein two hydraulic cylinders are provided and arranged symmetrically to one another with respect to the frame and/or slide.

8. The drive according to claim 1, further comprising a locking pawl arranged such that it is rotatable on the slide.

9. The drive according to claim 1, wherein the one side of the at least one hydraulic cylinder is a piston side of the at least one hydraulic cylinder or a cylinder side of the at least one hydraulic cylinder.

10. A method for operating a drive of a ground drilling device for driving a drill string into the soil in the pushing or pulling working direction with a frame, a movable slide movable back and forth relative to the frame, and at least one hydraulic cylinder between the frame and slide for moving the slide relative to the frame, comprising:

removing the at least one hydraulic cylinder from the frame and/or slide, and rotating transverse to its longitudinal axis to reverse the working direction.

* * * * *